US007044215B2

(12) United States Patent
Boyles

(10) Patent No.: US 7,044,215 B2
(45) Date of Patent: May 16, 2006

(54) APPARATUS AND METHOD FOR DRIVING SUBMERGED PUMPS

(75) Inventor: Greg Boyles, Dallas, TX (US)

(73) Assignee: New Horizon Exploration, Inc., Richardson, TX (US)

( * ) Notice: Subject to any disclaimer, the term of this patent is extended or adjusted under 35 U.S.C. 154(b) by 103 days.

(21) Appl. No.: 10/856,471

(22) Filed: May 28, 2004

(65) Prior Publication Data

US 2005/0205249 A1 Sep. 22, 2005

(51) Int. Cl.
*E21B 43/00* (2006.01)

(52) U.S. Cl. ..... 166/68.5; 166/78.1; 417/904

(58) Field of Classification Search ..... 166/68.5, 166/78.1; 417/904, 360
See application file for complete search history.

(56) References Cited

U.S. PATENT DOCUMENTS

| | | | | |
|---|---|---|---|---|
| 2,850,982 | A | 9/1958 | Fabrin | |
| 4,320,799 | A | 3/1982 | Gilbertson | |
| 4,372,379 | A * | 2/1983 | Kulhanek et al. | 166/68.5 |
| 4,407,360 | A | 10/1983 | Hamrick | |
| 4,423,774 | A * | 1/1984 | Mefford | 166/77.51 |
| 4,490,097 | A | 12/1984 | Gilbertson | |
| 5,222,553 | A * | 6/1993 | Temple | 166/68.5 |
| 5,573,063 | A * | 11/1996 | Morrow | 166/68.5 |
| 5,960,886 | A * | 10/1999 | Morrow | 166/369 |
| 6,079,489 | A * | 6/2000 | Hult et al. | 166/68.5 |
| 6,289,986 | B1 | 9/2001 | Wright et al. | |
| 2001/0050168 | A1 | 12/2001 | Hult | |
| 2003/0131987 | A1 | 7/2003 | Lam | |

* cited by examiner

*Primary Examiner*—Hoang Dang
(74) *Attorney, Agent, or Firm*—John A. Thomas

(57) ABSTRACT

I disclose an apparatus for driving a submerged pump in a well, of the kind where the pump has a driving rod. A motor is connected to a double-reduction helical gear drive, and the gear drive has a threaded output shaft. The gear drive output shaft is removably connected to the pump driving rod. There is a back plate; the motor and gear drive are connected together to the back plate. The back plate has at least one slotted track for vertically adjusting the position of the motor and gear drive above the pump driving rod. The apparatus has a drive head housing attached to the well head. A pivot connects the drive head housing and the back plate, so that the motor and gear drive may be pivoted clear of the pump driving rod when the gear drive and pump rod are disconnected. A back plate rest connected to the drive head housing supports the back plate (and the motor and gear drive) when the motor and gear drive are pivoted clear of the pump driving rod.

12 Claims, 4 Drawing Sheets

APPARATUS AND METHOD FOR DRIVING SUBMERGED PUMPS

FIELD OF THE INVENTION

The invention relates to the operation of submerged rotating pumps, particularly those used in the petroleum industry to lift fluids from zones of production.

BACKGROUND

Progressive-cavity pumps (PCPS) are frequently used in the petroleum industry to pump marginal wells. These pumps are typically driven by a motor mounted above the well head through a combination of pulleys and belts. Belt-driven systems present dangers and mechanical problems, such as fast back spin, the difficulty in varying the speed of the pulley system, the high maintenance cost associated with belt failures, and the difficulty in adjusting and or replacing belts and pulleys. Ultimately, because of the frequency of belt repairs and or tightening, workers remove belt guards and do not replace them, rendering the belt driven devices unsafe. Tens of thousands of dollars on a single well may be lost over time due to the operator's inability to make quick pump-speed adjustments to avoid dry pumping and for other problematic situations associated with belt drives.

Several drive head systems have been introduced and designed to address many but not all of the issues described above. Many of the solutions are workable but tend to be costly and therefore are not utilized in marginal oil field situations. There is a need for a pump-driving system that has fewer moving mechanical parts than conventional systems, that is more reliable, safer, and that can be adapted to modern electronic methods of speed control.

SUMMARY

I disclose an apparatus for driving a submerged pump in a well, of the kind where the pump has a driving rod. A motor is connected to a double-reduction helical gear drive, and the gear drive has a threaded output shaft. The gear drive output shaft is removably connected to the pump driving rod. There is a back plate; the motor and gear drive are connected together to the back plate.

The back plate has at least one slotted track for vertically adjusting the position of the motor and gear drive above the pump driving rod. The apparatus has a drive head housing attached to the well head. A pivot connects the drive head housing and the back plate, so that the motor and gear drive may be pivoted clear of the pump driving rod when the gear drive and pump rod are disconnected. A back plate rest connected to the drive head housing supports the back plate (and the motor and gear drive) when the motor and gear drive are pivoted clear of the pump driving rod.

Preferably, an electronic motor speed control and an electronic braking system are connected to the motor. A stuffing box, a rod blow-out preventer, and a pumping tee are formed as one piece with the drive head housing.

DETAILED DESCRIPTION

Figure 1:
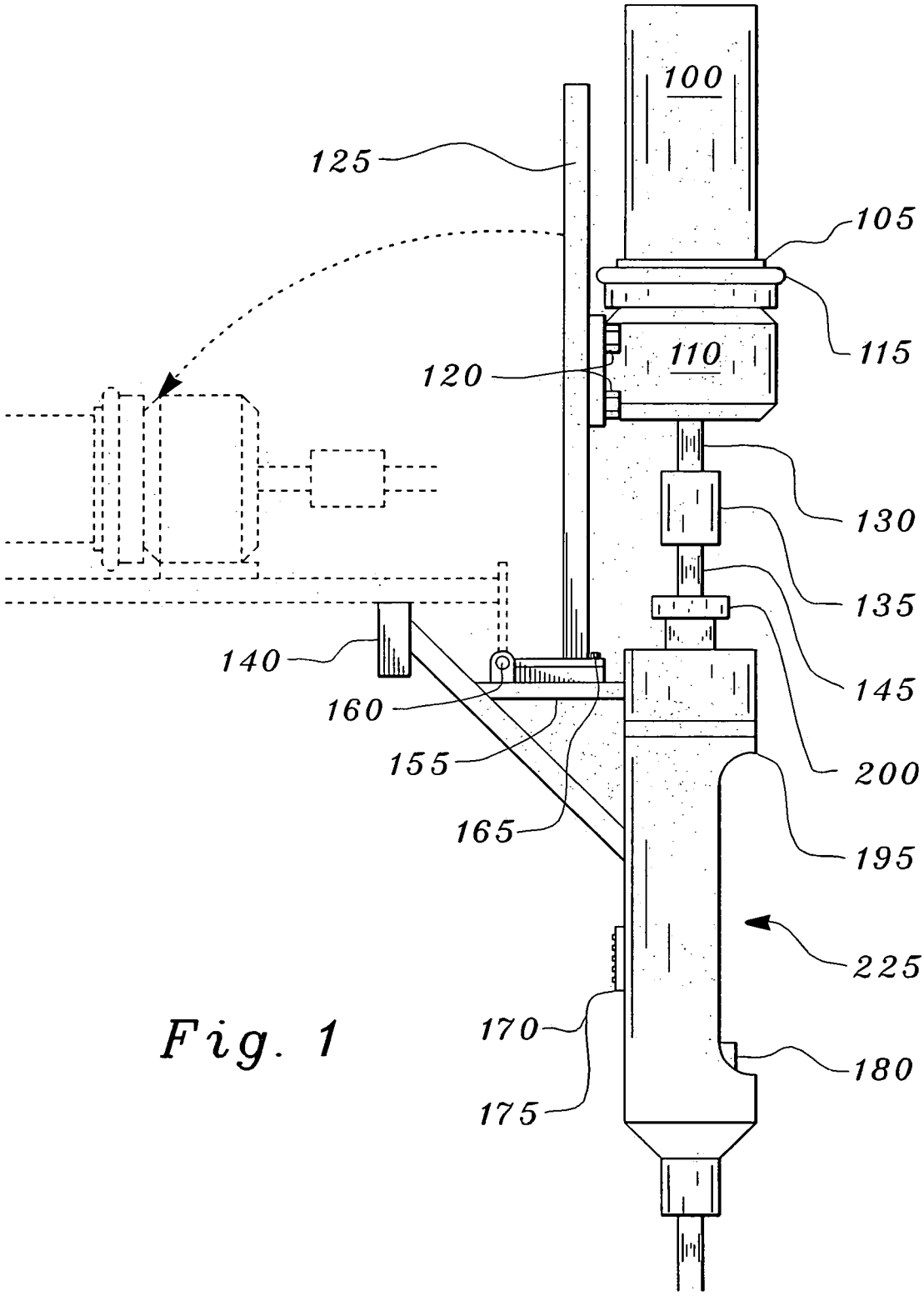
FIG. 1 is a side view of the preferred embodiment, showing the back plate raised to the upright, or in-line position above a well head.
Figure 2:
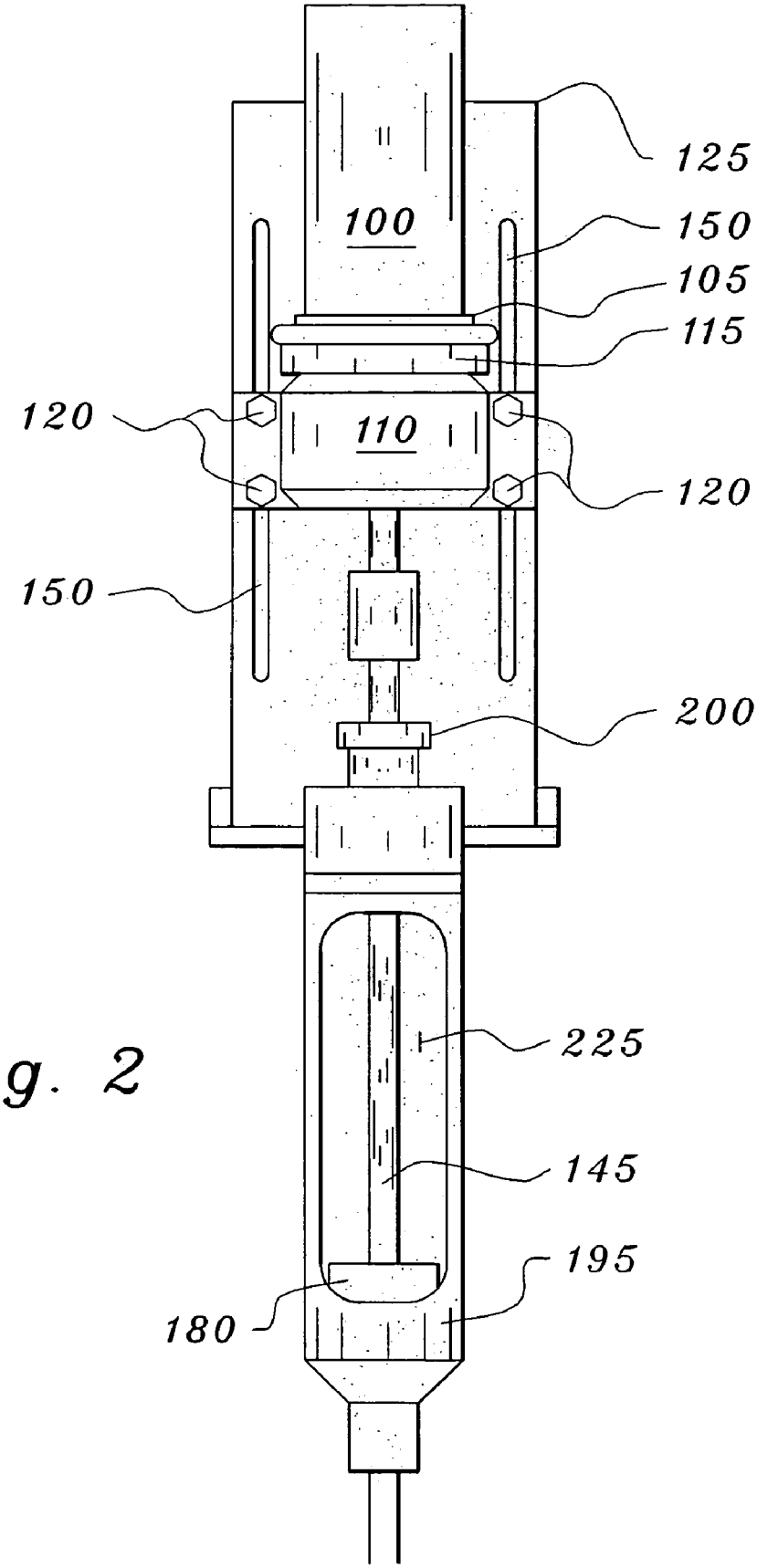
FIG. 2 is a front view of the preferred embodiment.
Figure 3:
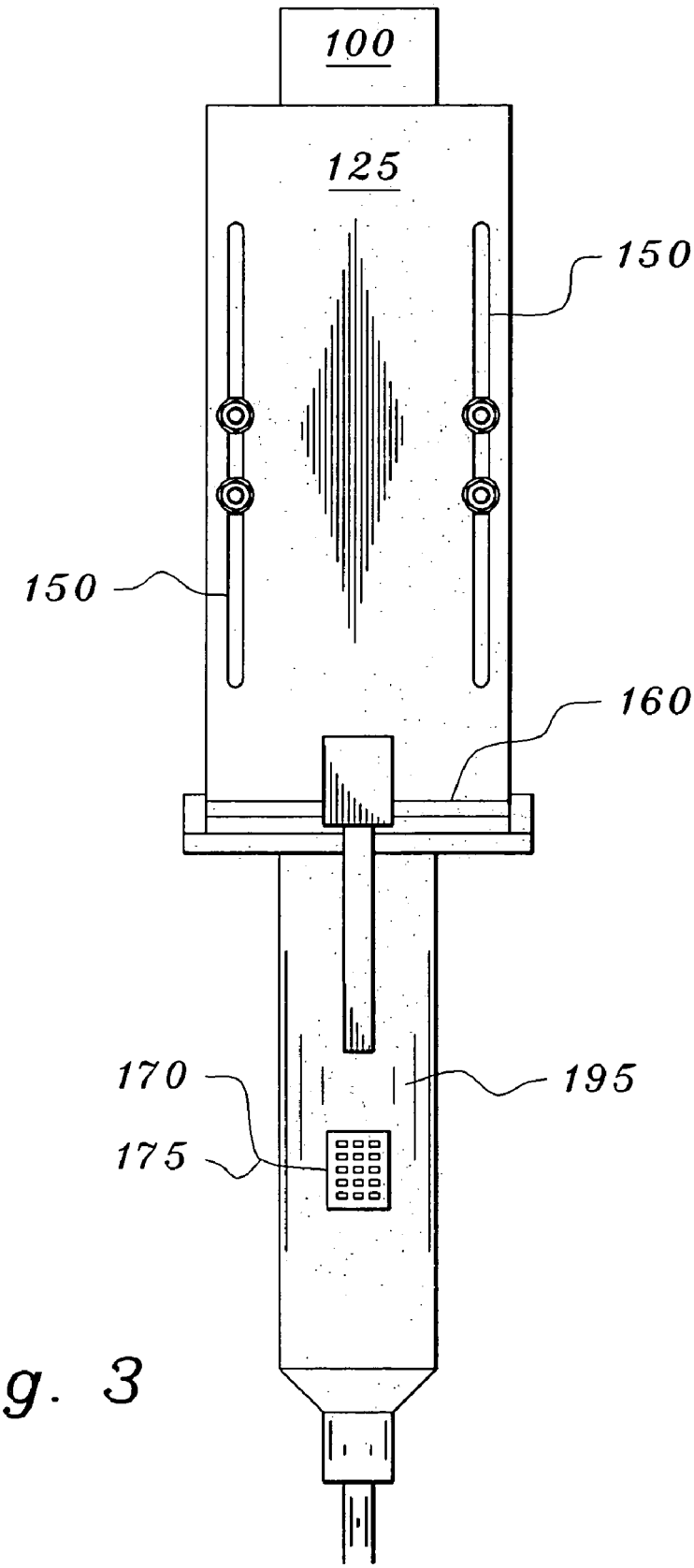
FIG. 3 is a rear view of the preferred embodiment.

The direct drive pumping unit uses an in-line approach, as shown in FIG. 1. An electric motor (100) manufactured with a flanged NEMA C output face plate (105) is bolted directly to an in-line double reduction helical gear drive (110) with a housing construction that supports a NEMA C input face plate (115).

The gear drive housing is preferably constructed with four foot mounts (120) to bolt the gear drive (110) (which also supports the electric motor (100)) to a pivoting back plate (125). When the pivoting back plate (125) is locked into the vertical or in-line position, as shown in FIG. 1, the output shaft (130) of the gear drive (110) is positioned directly over the polish rod box (135). When pivoted back onto the back plate rest (140), the gear drive (110) and electric motor (100) move out of the way, to enable the rod string to be pulled from the well without removing any portion of the drive head.

The preferred in-line double reduction helical gear drive (110) has interchangeable gears to allow the rotational speed of the output shaft (130) to be changed. The output shaft (130) of the double reduction helical gear drive (100) is preferably machine-threaded to match the standardized oil field polish rod box (135) so that no additional make-up devices or connectors are necessary when connecting the shaft (130) to the box (135) and then to the polish rod (145).

In another embodiment, the polish rod box element (135) may be a flexible joint, such that the flexible joint provides a safe pull-away disconnect if the rod clamp slips for any reason.

Once the well is spaced and the back plate (125) is raised to its in-line position, the electric motor (100) and gear drive (110) with output shaft (130) is lowered in place by sliding along its sliding rail or slotted track (150) until the output shaft (130) meets the rod box (135) and the two are joined by rotating the drive shaft (130) into the polish rod box (135). Once the shaft (130) is tightened, the bolts on the gear drive foot mounts (120) are tightened to the back plate (125) to provide support. At this point the out put shaft (130) of the gear drive (110) is connected directly into and in-line with a polish rod (145) and rod string, which then turns the PCP at a predetermined set speed; for example, if a 14:1 internal gear ratio assembly is used in conjunction with a 1750 rpm motor, than the output shaft speed (130) will be 125 rpm.

Vertical alignment and horizontal positioning are the same each time due to construction of the back plate (125). The anchor plate (155) and pivot assembly (160) attached to the back plate (125) provide this alignment. Once the back plate (125) is moved into the up position for operation, it is locked into place by bolting the back plate (125) to the back plate pivot (160) and mounting plate fastener (165).

A digital phase inverter and controller (170) is mounted onto the back portion of the direct drive pumping unit and enables the operator to instantly slow the electric motor rpm output up to a maximum of 50% without causing damage to the motor. Suitable controllers are available from Baldor Electric Company of Fort Smith, Ark. This controller thus slows by the same ratio the gear drive output with a push of a button, as opposed to changing mechanical aspects of the pumping unit the PCP speed can be varied.

To control back spin, the preferred embodiment does not employ a torque speed controller or any other type of mechanical back spin brake such as cams or other devices; however, the double reduction helical gear drive gear ratios serve to slow back spin because the higher the ratio, the greater resistance to back spin. To address the higher back spin rates associated with lower gear ratios, a dynamic electronic braking system (175) may be added to the electronic digital controller (170) section to control back spin by polarity changes which impart magnetic forces to slow the spin without the use of a mechanical braking design. Suitable electronic braking systems are available from Baldor Electric Company of Fort Smith, Ark.

Figure 4:
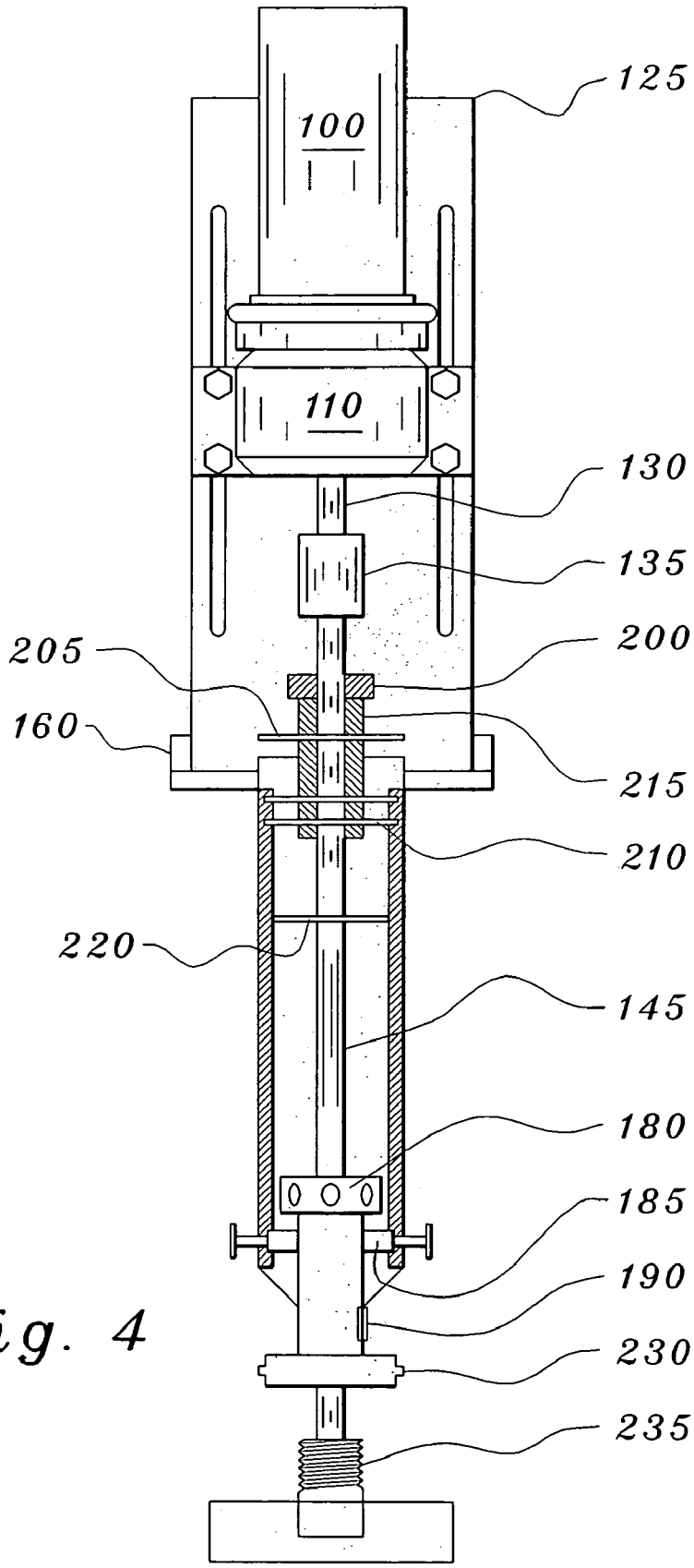
FIG. 4 is a front view of another embodiment, showing additional elements involved in connecting the drive system to a well head.

FIG. 4 shows another embodiment incorporating additional elements that assist in mounting the system to a well head (235). The direct drive pumping unit preferably incorporates a combination stuffing box (180), rod blow-out preventer (BOP) (185), and pumping tee assembly (190) at the bottom of the circular drive head housing (195). By machining all components into one piece, the need for additional nipples, flanges, tees, and or separate devices below the drive head section can be eliminated. This also lowers the in-line drive head profile and provides the operator with a means of controlling a well while the rods are pulled in case of a blow out, or to replace the packing in the stuffing box in a flowing well scenario.

The fluid control rod BOP (185) incorporates the use of two 2" bullplug mounted directly below and on opposite sides of the packing section of the stuffing box (180). A tap screw with hand crank passes through the end of the bullplugs into an injection molded rubber piston (not shown), which, when tightened inward, fits snugly around the rod string (145) to control flowing pressure and fluid. Once closed, the well can be killed by pumping weighted water through the tee (190) below the BOP (185).

A polish rod clamp (200) keeps the rod string (145) from slipping into the well and also serves as an interlocking element to a load bearing shaft (215). Internal load bearings (210) support the rod string (145) and enable the drive system to rotate the rod string (145) and PCP. A top (205) and bottom (220) cap with oil seals keep oil contained within the bearing sections. An opening (225) along the circular drive head housing (195) enables access to the stuffing box section (180). A hammer union (230) may be used to simply attach the drive head to a nipple above the well head (235).

Since those skilled in the art can modify the specific embodiments described above, I intend that the claims be interpreted to cover such modifications and equivalents.

I claim:

1. An apparatus for driving a submerged pump in a well; the pump having a driving rod; comprising:

a motor;

a gear drive; the motor connected to the gear drive;

the gear drive removably connected to the pump driving rod;

a back plate; the motor and gear drive connected to the back plate;

a drive head housing attached to the well head; and, a pivot connecting the drive head housing and the back plate, so that the motor and gear drive may be pivoted clear of the pump driving rod when the gear drive and pump rod are disconnected.

2. The apparatus of claim 1, further comprising a means for vertically adjusting the position of the motor and gear drive above the pump driving rod.

3. The apparatus of claim 2 above where the means for vertically adjusting the position of the motor and gear drive above the pump driving rod comprises bolts in at least one slotted track in the back plate.

4. The apparatus of claim 1, further comprising a back plate rest, for supporting the back plate when the motor and gear drive are pivoted clear of the pump driving rod.

5. The apparatus of claim 1, where the gear drive has an output shaft; the output shaft having threads to engage the pump driving rod.

6. The apparatus of claim 1 where the gear drive is a double reduction helical gear drive.

7. The apparatus of claim 1 further comprising an electronic motor speed control connected to the motor for controlling the motor speed.

8. The apparatus of claim 1 further comprising an electronic braking system connected to the motor.

9. The apparatus of claim 1, where the gear drive is removably connected to the pump driving rod with a flexible joint.

10. The apparatus of claim 1 where the drive head housing further comprises a stuffing box, a rod blow-out preventer, and a pumping tee.

11. The apparatus of claim 10 where the drive head housing, the stuffing box, the rod blow-out preventer, and the pumping tee are constructed as one piece.

12. An apparatus for driving a submerged pump in a well; the pump having a driving rod; comprising:

a motor;

a double-reduction helical gear drive; the motor connected to the gear drive;

the gear drive having a threaded output shaft; the gear drive output shaft removably connected to the pump driving rod;

a back plate; the motor and gear drive connected to the back plate;

the back plate having at least one slotted track for vertically adjusting the position of the motor and gear drive above the pump driving rod;

a drive head housing attached to the well head;

a pivot connecting the drive head housing and the back plate, so that the motor and gear drive may be pivoted clear of the pump driving rod when the gear drive and pump rod are disconnected;

a back plate rest connected to the drive head housing, for supporting the back plate when the motor and gear drive are pivoted clear of the pump driving rod;

an electronic motor speed control connected to the motor;

an electronic braking system connected to the motor; and, a stuffing box, a rod blow-out preventer, and a pumping tee formed as one piece with the drive head housing.

* * * * *